US010920323B2

(12) United States Patent
Terashima et al.

(10) Patent No.: US 10,920,323 B2
(45) Date of Patent: Feb. 16, 2021

(54) INSULATING-COATED ORIENTED MAGNETIC STEEL SHEET AND METHOD FOR MANUFACTURING SAME

(71) Applicant: JFE STEEL CORPORATION, Tokyo (JP)

(72) Inventors: Takashi Terashima, Tokyo (JP); Kazutoshi Hanada, Tokyo (JP); Ryuichi Suehiro, Tokyo (JP); Makoto Watanabe, Tokyo (JP); Toshito Takamiya, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 91 days.

(21) Appl. No.: 15/561,369

(22) PCT Filed: Mar. 11, 2016

(86) PCT No.: PCT/JP2016/057850
§ 371 (c)(1),
(2) Date: Sep. 25, 2017

(87) PCT Pub. No.: WO2016/158325
PCT Pub. Date: Oct. 6, 2016

(65) Prior Publication Data

US 2018/0080127 A1 Mar. 22, 2018

(30) Foreign Application Priority Data

Mar. 27, 2015 (JP) ..... 2015-067254

(51) Int. Cl.
*C23C 22/22* (2006.01)
*C23C 22/74* (2006.01)
(Continued)

(52) U.S. Cl.
CPC ..... *C23C 22/22* (2013.01); *C23C 22/12* (2013.01); *C23C 22/18* (2013.01); *C23C 22/20* (2013.01);
(Continued)

(58) Field of Classification Search
CPC ..... C23C 22/22; C23C 22/12; C23C 22/18; C23C 22/20; C23C 22/33; C23C 22/42; C23C 22/74; C23C 22/82
(Continued)

(56) References Cited

U.S. PATENT DOCUMENTS 3,856,568 A * 12/1974 Tanaka ..... C21D 1/70 427/330
3,940,291 A * 2/1976 Evans ..... C23C 22/74 148/245
(Continued)

FOREIGN PATENT DOCUMENTS

CN 1048554 A 1/1991
CN 104011246 A 8/2014
(Continued)

OTHER PUBLICATIONS

JP-05287546-A, machine translation, originally published 1993, p. 1-12 (Year: 1993).*
(Continued)

*Primary Examiner* — Katherine A Bareford
*Assistant Examiner* — Christina D McClure
(74) *Attorney, Agent, or Firm* — RatnerPrestia

(57) ABSTRACT

Provided are an insulating-coated oriented magnetic steel sheet having an insulating coating of excellent heat resistance, and a method for manufacturing the same. This insulating-coated oriented magnetic steel sheet has an oriented magnetic steel sheet, and an insulating coating arranged on the surface of the oriented magnetic steel sheet.
(Continued)

The insulating coating contains Si, P, and O, and at least one element selected from the group consisting of Mg, Ca, Ba, Sr, Zn, Al, and Mn, the K-absorption edge of the P in the insulating coating having an XAFS spectrum that exhibits three absorption peaks from 2156 eV to 2180 eV.

4 Claims, 1 Drawing Sheet

(51) Int. Cl.

| | |
|---|---|
| ***C23C 22/42*** | (2006.01) |
| ***C23C 22/33*** | (2006.01) |
| ***C23C 22/12*** | (2006.01) |
| ***C23C 22/20*** | (2006.01) |
| ***C23C 22/18*** | (2006.01) |

(52) U.S. Cl.
CPC ..... *C23C 22/33* (2013.01); *C23C 22/42* (2013.01); *C23C 22/74* (2013.01)

(58) Field of Classification Search
USPC ..... 427/535
See application file for complete search history.

(56) References Cited

U.S. PATENT DOCUMENTS

| | | | | |
|---|---|---|---|---|
| 3,985,583 | A | | 10/1976 | Shimanaka et al. |
| 4,772,338 | A | * | 9/1988 | Fukuda ..... C21D 1/09 148/112 |
| 5,174,833 | A | * | 12/1992 | Tanaka ..... C21D 8/1283 148/113 |
| 5,961,744 | A | | 10/1999 | Yamazaki et al. |
| 8,771,795 | B2 | | 7/2014 | Muraki et al. |
| 9,646,749 | B2 | | 5/2017 | Suehiro et al. |
| 2011/0039120 | A1 | | 2/2011 | Fujii et al. |
| 2016/0230240 | A1 | | 8/2016 | Senda et al. |

FOREIGN PATENT DOCUMENTS

| | | | | | |
|---|---|---|---|---|---|
| GB | 1042589 | A | * | 9/1966 | |
| JP | 4839338 | A | | 6/1973 | |
| JP | 5079442 | A | | 6/1975 | |
| JP | 6296617 | A | | 5/1987 | |
| JP | 024924 | A | | 1/1990 | |
| JP | 03207868 | A | | 9/1991 | |
| JP | 05287546 | A | | 11/1993 | |
| JP | 05287546 | A | * | 11/1993 | |
| JP | 0645824 | B2 | | 6/1994 | |
| JP | 07188754 | A | * | 7/1995 | ..... H01F 1/14775 |
| JP | 07278830 | A | | 10/1995 | |
| JP | 2000169972 | A | | 6/2000 | |
| JP | 2004162112 | A | | 6/2004 | |
| JP | 2008266743 | A | | 11/2008 | |
| JP | 2011246782 | A | * | 12/2011 | |
| JP | 5328375 | B2 | | 10/2013 | |
| RU | 2430165 | C1 | | 9/2011 | |
| WO | 2009154139 | A1 | | 12/2009 | |
| WO | 2015040799 | A1 | | 3/2015 | |

OTHER PUBLICATIONS

JP-2011246782-A, machine translation, originally published 2011, p. 1-12 (Year: 2011).*
JP-07188754-A, machine translation, originally published 1993, p. 1-16 (Year: 1995).*
Chinese Office Action for Chinese Application No. 201680016940.7, dated Dec. 28, 2018, with Search Report, 13 pages.
Russian Office Action for Russian Application No. 2017133478, dated Jul. 31, 2018 with translation, 9 pages.
Japanese Office Action for Japanese Application No. 2016-534273, dated Nov. 28, 2017, including Concise Statement of Relevance of Office Action, 7 pages.
Extended European Search Report for European Application No. 16 772 209.9, dated Mar. 7, 2018, 8 pages.
International Search Report and Written Opinion for International Application PCT/JP2016/057850, dated Apr. 12, 2016—7 Pages.
Japanese Office Action for Japanese Application No. 2016/534273, dated Jun. 27, 2017 with Concise Statement of Relevance of Office Action, 10 Pages.
Korean Office Action for Korean Application No. 10-2017-7025494, dated Dec. 19, 2018, with Concise Statement of Relevance of Office Action, 6 pages.
European Communication pursuant to Article 94(3) for European Application No. 16 772 209.9, dated Oct. 16, 2020, 5 pages.

* cited by examiner

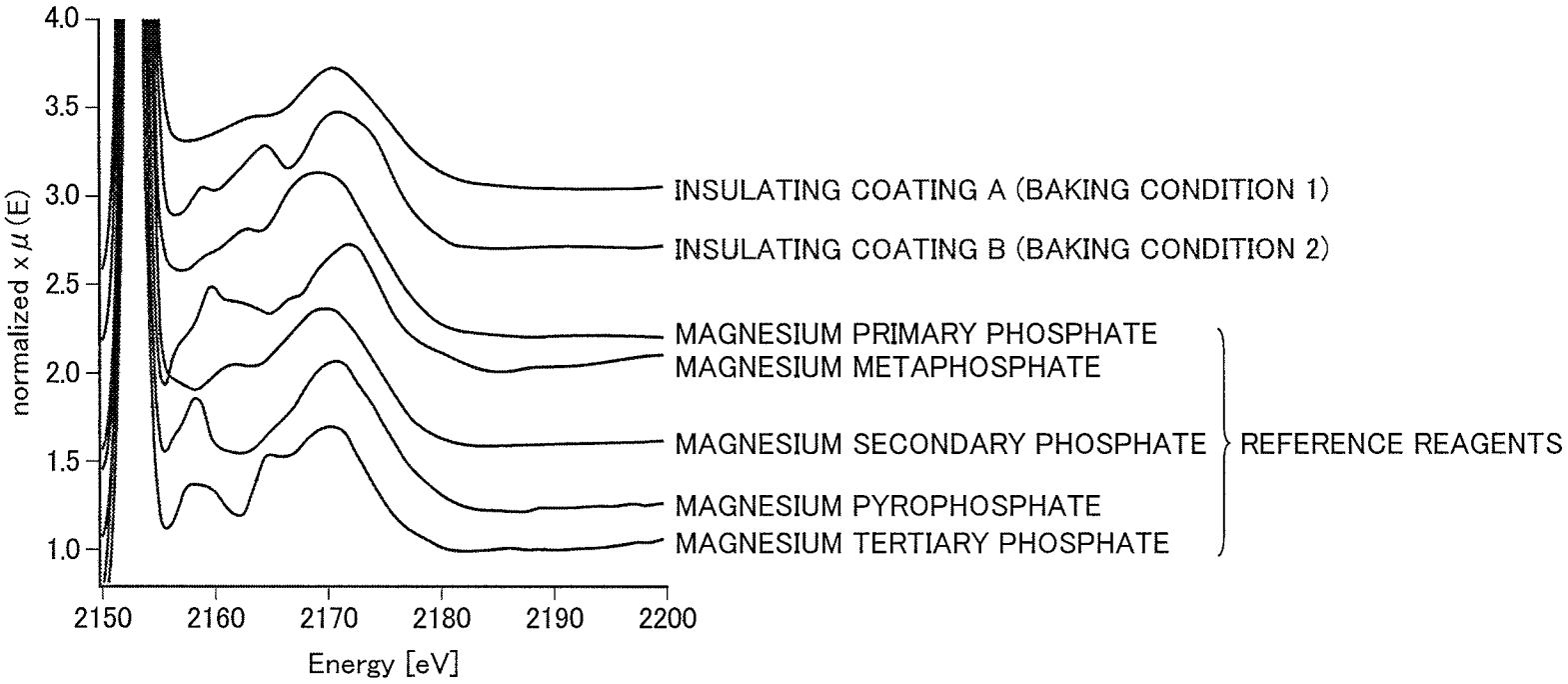
INSULATING COATING A (BAKING CONDITION 1)
INSULATING COATING B (BAKING CONDITION 2)
MAGNESIUM PRIMARY PHOSPHATE
MAGNESIUM METAPHOSPHATE
MAGNESIUM SECONDARY PHOSPHATE
MAGNESIUM PYROPHOSPHATE
MAGNESIUM TERTIARY PHOSPHATE
REFERENCE REAGENTS
normalized x μ (E)
4.0
3.5
3.0
2.5
2.0
1.5
1.0
2150
2160
2170
2180
2190
2200
Energy [eV]

INSULATING-COATED ORIENTED MAGNETIC STEEL SHEET AND METHOD FOR MANUFACTURING SAME

CROSS REFERENCE TO RELATED APPLICATIONS

This is the U.S. National Phase application of PCT/JP2016/057850, filed Mar. 11, 2016, which claims priority to Japanese Patent Application No. 2015-067254, filed Mar. 27, 2015, the disclosures of each of these applications being incorporated herein by reference in their entireties for all purposes.

TECHNICAL FIELD OF THE INVENTION

The present invention relates to a grain oriented electrical steel sheet with an insulating coating, and a method of manufacturing the same.

BACKGROUND OF THE INVENTION

In general, a grain oriented electrical steel sheet (hereinafter also referred to simply as "steel sheet") is provided with a coating on its surface to impart insulation properties, workability, corrosion resistance and other properties. Such a surface coating includes an undercoating primarily composed of forsterite and formed in final finishing annealing, and a phosphate-based top coating formed on the undercoating.

Of the coatings formed on the surface of the grain oriented electrical steel sheet, only the latter top coating is hereinafter called "insulating coating."

These coatings are formed at high temperature and further have a low coefficient of thermal expansion, and are therefore effective in imparting tension to the steel sheet owing to a difference in coefficient of thermal expansion between the steel sheet and the coatings when the temperature drops to room temperature, thus reducing iron loss of the steel sheet. Accordingly, the coatings are required to impart the highest possible tension to the steel.

In order to meet such a requirement, for example, Patent Literatures 1 and 2 disclose insulating coatings each formed using a treatment solution containing a phosphate (e.g., aluminum phosphate, magnesium phosphate), colloidal silica, and chromic anhydride.

In recent years, Cr-free insulating coatings are also under development to meet the rising demand for environmental protection, and for example, Patent Literature 3 discloses a technique using a colloidal oxide instead of chromic anhydride.

The grain oriented electrical steel sheet with an insulating coating may be hereinafter also simply called "grain oriented electrical steel sheet" or "steel sheet."

PATENT LITERATURE

Patent Literature 1: JP 48-39338 A
Patent Literature 2: JP 50-79442 A
Patent Literature 3: JP 2000-169972 A

SUMMARY OF THE INVENTION

Users of grain oriented electrical steel sheets, and in particular clients manufacturing wound-core transformers perform stress relief annealing at a temperature exceeding 800° C. after formation of cores for wound-core transformers through lamination of steel sheets to thereby release stress generated in the formation of the cores, thus eliminating deterioration of magnetic properties.

In this step, when the insulating coating is low in heat resistance, laminated steel sheets may stick to each other to lower the workability in the subsequent step. Sticking may also deteriorate magnetic properties.

The inventors of the present invention have studied the insulating coatings disclosed in Patent Literatures 1 to 3, and as a result found that sticking may not be adequately suppressed due to insufficient heat resistance.

The present invention has been made in view of the above and aims at providing a grain oriented electrical steel sheet with an insulating coating having a highly heat-resistant insulating coating, and a method of manufacturing the same.

The inventors of the present invention have made an intensive study to achieve the above-described object, and as a result found that variations in the state of P—O bonds in an insulating coating have an influence on whether the heat resistance is good, and also found a technique for controlling the state of P—O bonds in the insulating coating to be in a state showing good heat resistance. The present invention has been thus completed.

Specifically, the invention includes providing the following (1) to (6).

(1) A grain oriented electrical steel sheet with an insulating coating, comprising: a grain oriented electrical steel sheet; and an insulating coating provided on a surface of the grain oriented electrical steel sheet, wherein the insulating coating contains at least one selected from the group consisting of Mg, Ca, Ba, Sr, Zn, Al and Mn, and Si, P, and O, and wherein a P K-absorption edge XAFS spectrum of the insulating coating shows three absorption peaks between 2156 eV and 2180 eV.

(2) A method of manufacturing the grain oriented electrical steel sheet with an insulating coating according to (1) above, the grain oriented electrical steel sheet with an insulating coating being obtained by performing baking after applying a treatment solution to a surface of a grain oriented electrical steel sheet having undergone finishing annealing, wherein the treatment solution contains a phosphate of at least one selected from the group consisting of Mg, Ca, Ba, Sr, Zn, Al and Mn, and colloidal silica, wherein a colloidal silica content in the treatment solution in terms of solid content is 50 to 150 parts by mass with respect to 100 parts by mass of total solids in the phosphate, and wherein conditions of the baking in which a baking temperature T (unit: ° C.) ranges $850 \leq T \leq 1000$, a hydrogen concentration $H_2$ (unit: vol %) in a baking atmosphere ranges $0.3 \leq H_2 \leq 230-0.2T$, and a baking time Time (unit: s) at the baking temperature T ranges $5 \leq Time \leq 860-0.8T$ are met.

(3) The method of manufacturing the grain oriented electrical steel sheet with an insulating coating according to (2) above, wherein the grain oriented electrical steel sheet having undergone finishing annealing and having the treatment solution applied thereto is retained at a temperature of 150 to 450° C. for 10 seconds or more before being subjected to the baking.

(4) A method of manufacturing the grain oriented electrical steel sheet with an insulating coating according to (1) above, the grain oriented electrical steel sheet with an insulating coating being obtained by performing baking and plasma treatment in this order after applying a treatment solution to a surface of a grain oriented electrical steel sheet having undergone finishing annealing, wherein the treatment solution contains a phosphate of at least one selected from the group consisting of Mg, Ca, Ba, Sr, Zn, Al and Mn, and colloidal silica, wherein a colloidal silica content in the treatment solution in terms of solid content is 50 to 150 parts by mass with respect to 100 parts by mass of total solids in the phosphate, wherein conditions of the baking in which a baking temperature T (unit: ° C.) ranges $800 \leq T \leq 1000$, a hydrogen concentration $H_2$ (unit: vol %) in a baking atmosphere ranges $0 \leq H_2 \leq 230-0.2T$, and a baking time Time (unit: s) at the baking temperature T ranges Time≤300 are met, and wherein the plasma treatment is a treatment which includes irradiating the surface of the grain oriented electrical steel sheet after the baking with plasma generated from plasma gas containing at least 0.3 vol % of hydrogen for 0.10 seconds or more.

(5) The method of manufacturing the grain oriented electrical steel sheet with an insulating coating according to (4) above, wherein the grain oriented electrical steel sheet having undergone finishing annealing and having the treatment solution applied thereto is retained at a temperature of 150 to 450° C. for 10 seconds or more before being subjected to the baking and the plasma treatment.

(6) The method of manufacturing the grain oriented electrical steel sheet with an insulating coating according to any one of (2) to (5) above, wherein when at least one selected from the group consisting of Ti, V, Cr, Mn, Fe, Co, Ni, Cu, Zn, Zr, Mo, and W is denoted by M, the treatment solution further contains an M compound, and the M compound is contained in the treatment solution in an amount in terms of oxide of 10 to 100 parts by mass with respect to 100 parts by mass of total solids in the phosphate.

The present invention can provide a grain oriented electrical steel sheet with an insulating coating having a highly heat-resistant insulating coating, and a method of manufacturing the same.

BRIEF DESCRIPTION OF THE DRAWINGS

FIG. 1 shows P K-absorption edge XAFS spectra in insulating coatings and reference reagents.

DETAILED DESCRIPTION OF EMBODIMENTS OF THE INVENTION

[Findings Made by Inventors]

Findings of XAFS (X-ray absorption fine structure) that have led the inventors to complete the present invention are first described.

A grain oriented electrical steel sheet that had been manufactured by a known method, had a sheet thickness of 0.23 mm, and had undergone finishing annealing was sheared to a size of 300 mm×100 mm, and an unreacted annealing separator was removed. Thereafter, stress relief annealing (800° C., 2 hours, $N_2$ atmosphere) was performed.

Next, a treatment solution for insulating coating formation was applied to the steel sheet that had been slightly pickled in 5 mass % phosphoric acid. The treatment solution contained 100 parts by mass (in terms of solid content) of an aluminum primary phosphate aqueous solution and 80 parts by mass (in terms of solid content) of colloidal silica, and the treatment solution was applied so that the coating amount on both surfaces after baking became 10 g/m$^2$.

The steel sheet to which the treatment solution had been applied was placed in a drying furnace, and dried at 300° C. for 1 minute. Then, the steel sheet was baked under two different baking conditions to obtain two types of grain oriented electrical steel sheets each with an insulating coating. A first baking condition (baking condition 1) involved 1-minute baking at 850° C. in a 100% $N_2$ atmosphere. A second baking condition (baking condition 2) involved 30-second baking at 900° C. in a mixed atmosphere of 95 vol % nitrogen and 5 vol % hydrogen.

For the sake of convenience, an insulating coating of a steel sheet obtained under the baking condition 1 and an insulating coating of a steel sheet obtained under the baking condition 2 may be referred to as "insulating coating A" and "insulating coating B," respectively.

Next, the heat resistance of the insulating coating A and the insulating coating B was evaluated by a drop weight test. Specifically, each resulting steel sheet was sheared into specimens measuring 50 mm×50 mm, 10 specimens were stacked on top of one another, and annealing under a compressive load of 2 kg/cm$^2$ was performed in a nitrogen atmosphere at 830° C. for 3 hours. Then, a weight of 500 g was dropped from heights of 20 to 120 cm at intervals of 20 cm to evaluate the heat resistance of the insulating coating based on the height of the weight (drop height) at which the 10 specimens were all separated from each other. In a case in which the 10 specimens were all separated from each other after the annealing under compressive loading but before the drop weight test, the drop height was set to 0 cm.

When the specimens were separated from each other at a drop height of 40 cm or less, the insulating coating was rated as having excellent heat resistance. The insulating coating A showed a drop height of 100 cm and was inferior in heat resistance. On the other hand, it was confirmed that the insulating coating B showed a drop height of 40 cm and exhibited good heat resistance.

The insulating coating A and the insulating coating B which are thus different in drop height (heat resistance) were intensively studied for differences therebetween, and as a result it was found out that the insulating coatings are different in P K-absorption edge XAFS spectrum. This is described below.

In order to check the bonding state of P in the insulating coating A and the insulating coating B, P K-absorption edge (2146 eV) XAFS measurement was performed by a total electron yield method (TEY) using a soft X-ray beam line BL-27A of the Photon Factory in the Institute of Materials Structure Science of the High Energy Accelerator Research Organization (KEK-PF). This measurement does not depend on a measurement facility and a beam line but can also be performed in other synchrotron radiation facilities (for example, SPring-8, Ritsumeikan University SR Center). Just to make sure, it is preferred in the measurement to measure $FePO_4$, for example, as a reference material to set the white line at 2153 eV or to measure various magnesium phosphate reagents to check the absolute accuracy in peak position. The absorption intensity may also be normalized for each measurement using Ni mesh or the like.

FIG. 1 shows P K-absorption edge XAFS spectra in insulating coatings and reference reagents. Specifically, FIG. 1 shows P K-absorption edge XAFS spectra in the insulating coating A and the insulating coating B as well as five types of reference reagents (magnesium primary phosphate, magnesium metaphosphate, magnesium secondary phosphate, magnesium pyrophosphate, and magnesium tertiary phosphate). Every spectrum has one or more absorption peaks (corresponding to fine structures) present between 2156 eV and 2180 eV. A comparison between the insulating coating A inferior in heat resistance (baking condition 1) and the insulating coating B superior in heat resistance (baking condition 2) showed that they have different absorption peaks present between 2156 eV and 2180 eV, and the insulating coating A has a strong peak near 2172 eV, whereas the insulating coating B has three peaks near 2158 eV, 2165 eV and 2172 eV.

From the examination of the state of P by comparison to the peaks of the reference reagents, it is presumed that P in the insulating coating A inferior in heat resistance is in the state closer to the primary phosphate material even after baking, whereas P in the insulating coating B superior in heat resistance is closer to the state of P in the tertiary phosphate.

A primary phosphate is converted into a secondary phosphate and further a tertiary phosphate as a result of dehydration condensation of the phosphate, and hence it is presumed that a condensation reaction of the phosphate proceeds in the insulating coating B superior in heat resistance. It is presumed that, when the condensation reaction proceeds, the number of P—O bonds is increased to strengthen the structure while increasing the viscosity of the primarily glassy insulating coating at high temperature, whereby sticking is less likely to occur and the heat resistance is improved.

Next, a grain oriented electrical steel sheet with an insulating coating according to an embodiment of the invention is described again before also describing its manufacturing method.

[Grain Oriented Electrical Steel Sheet with Insulating Coating]

The grain oriented electrical steel sheet with an insulating coating according to an embodiment of the invention (hereinafter also referred to simply as "grain oriented electrical steel sheet of the invention" or "steel sheet of the invention") includes a grain oriented electrical steel sheet; and an insulating coating provided on a surface of the grain oriented electrical steel sheet, wherein the insulating coating contains at least one selected from the group consisting of Mg, Ca, Ba, Sr, Zn, Al and Mn, and Si, P, and O, and wherein a P K-absorption edge XAFS spectrum of the insulating coating shows three absorption peaks between 2156 eV and 2180 eV.

The respective elements contained in the insulating coating can be checked for their presence by a conventionally known method, but according to the invention, an insulating coating formed using a treatment solution containing a phosphate of at least one selected from the group consisting of Mg, Ca, Ba, Sr, Zn, Al and Mn, and colloidal silica is deemed to contain at least one selected from the group consisting of Mg, Ca, Ba, Sr, Zn, Al and Mn, and Si, P, and O.

The P K-absorption edge XAFS spectrum of the insulating coating according to an embodiment of the invention shows three absorption peaks between 2156 eV and 2180 eV (see FIG. 1). This shows excellent heat resistance as described above.

The grain oriented electrical steel sheet is not particularly limited but a conventionally known grain oriented electrical steel sheet may be used. The grain oriented electrical steel sheet is usually manufactured by a process which involves performing hot rolling of a silicon-containing steel slab by means of a known method, performing one cold rolling step or a plurality of cold rolling steps including intermediate annealing to finish the steel slab to a final thickness, thereafter performing primary recrystallization annealing, then applying an annealing separator, and performing final finishing annealing.

[Method of Manufacturing Grain Oriented Electrical Steel Sheet with Insulating Coating]

Next, a method of manufacturing a grain oriented electrical steel sheet with an insulating coating according to an embodiment of the invention (hereinafter also referred to simply as "manufacturing method of the invention") that is for obtaining the steel sheet of the invention is described by way of embodiments.

First and second embodiments of the manufacturing method of the invention are now described.

First Embodiment

The first embodiment of the manufacturing method of the invention is a method of manufacturing the grain oriented electrical steel sheet with an insulating coating according to the invention, the grain oriented electrical steel sheet with an insulating coating being obtained by performing baking after applying a treatment solution to a surface of a grain oriented electrical steel sheet having undergone finishing annealing, wherein the treatment solution contains a phosphate of at least one selected from the group consisting of Mg, Ca, Ba, Sr, Zn, Al and Mn, and colloidal silica, wherein a colloidal silica content in the treatment solution in terms of solid content is 50 to 150 parts by mass with respect to 100 parts by mass of total solids in the phosphate, and wherein conditions of the baking in which a baking temperature T (unit: ° C.) ranges $850 \leq T \leq 1000$, a hydrogen concentration $H_2$ (unit: vol %) in a baking atmosphere ranges $0.3 \leq H_2 \leq 230-0.2T$, and a baking time Time (unit: s) at the baking temperature T ranges $5 \leq Time \leq 860-0.8T$ are met.

<Treatment Solution>

The treatment solution is a treatment solution for forming the insulating coating that contains at least a phosphate of at least one selected from the group consisting of Mg, Ca, Ba, Sr, Zn, Al and Mn, and colloidal silica.

(Phosphate)

The metal species of the phosphate is not particularly limited as long as at least one selected from the group consisting of Mg, Ca, Ba, Sr, Zn, Al and Mn is used. Phosphates of alkali metals (e.g., Li and Na) are significantly inferior in heat resistance and moisture absorption resistance of a resulting insulating coating and hence inappropriate.

The phosphates may be used singly or in combination of two or more. Physical property values of the resulting insulating coating can be precisely controlled by using two or more phosphates in combination.

A primary phosphate (biphosphate) is advantageously used as such a phosphate from the viewpoint of availability.

(Colloidal Silica)

The colloidal silica preferably has an average particle size of 5 to 200 nm, and more preferably 10 to 100 nm from the viewpoint of availability and costs. The average particle size of the colloidal silica can be measured by the BET method (in terms of specific surface area using an adsorption method). It is also possible to use instead an average value of actual measurement values on an electron micrograph.

The colloidal silica content in the treatment solution in terms of $SiO_2$ solid content is 50 to 150 parts by mass and preferably 50 to 100 parts by mass with respect to 100 parts by mass of total solids in the phosphate.

Too low a colloidal silica content may impair the effect of reducing the coefficient of thermal expansion of the insulating coating, thus reducing the tension to be applied to the steel sheet. On the other hand, too high a colloidal silica content may cause crystallization of the insulating coating to proceed easily at the time of baking to be described later, thus also reducing the tension to be applied to the steel sheet.

However, when the colloidal silica content is within the above-described range, the insulating coating imparts a proper tension to the steel sheet and is highly effective in improving the iron loss.

(M Compound)

According to the invention, when at least one selected from the group consisting of Ti, V, Cr, Mn, Fe, Co, Ni, Cu, Zn, Zr, Mo, and W is denoted by M, the treatment solution may further contain an M compound. With this, the insulating coating has an improved tension to be applied to the steel sheet to be highly effective in improving the iron loss, and also has an excellent moisture absorption resistance.

Although the form of the M compound contained in the treatment solution is not particularly limited, a water-soluble metal salt form is particularly preferred, and an oxide form is preferred next. An exemplary oxide is a particulate oxide having a primary particle size of 1 μm and preferably 500 nm or less.

Examples of the Ti compound include $TiO_2$ and $Ti_2O_3$.

Examples of the V compound include $NH_4VO_3$ and $V_2O_5$.

An exemplary Cr compound is a chromic acid compound, specific examples thereof including chromic anhydride ($CrO_3$), a chromate, and a bichromate.

Examples of the Mn compound include $Mn(NO_3)_2$, $MnSO_4$, and $MnCO_3$.

Examples of the Fe compound include $(NH_4)_2Fe(SO_4)_2$, $Fe(NO_3)_3$, $FeSO_4.7H_2O$, and $Fe_2O_3$.

Examples of the Co compound include $Co(NO_3)_2$ and $CoSO_4$.

Examples of the Ni compound include $Ni(NO_3)_2$ and $NiSO_4$.

Examples of the Cu compound include $Cu(NO_3)_2$ and $CuSO_4$. $5H_2O$.

Examples of the Zn compound include $Zn(NO_3)_2$, $ZnSO_4$, and $ZnCO_3$.

Examples of the Zr compound include $Zr(SO_4)_2.4H_2O$ and $ZrO_2$.

Examples of the Mo compound include $MoS_2$ and $MoO_2$.

Examples of the W compound include $K_2WO_4$ and $WO_3$.

The M compounds as described above may be used singly or in combination of two or more.

The M compound content in the treatment solution in terms of oxide is preferably 5 to 150 parts by mass and more preferably 10 to 100 parts by mass with respect to 100 parts by mass of total solids in the phosphate.

When the M compound content is too low, the improvement effect may not be adequately obtained. On the other hand, when the M compound content is too high, a dense glassy coating serving as the insulating coating may not be easily obtained to hinder adequate improvement of the tension to be applied to the steel sheet.

However, when the M compound content is within the above-described range, the insulating coating is more highly effective in improving the iron loss.

The expression "in terms of oxide" in the M compound content is specifically illustrated for each of metal species of M, which is as follows:

Ti: in terms of $TiO_2$; V: in terms of $V_2O_5$; Cr: in terms of $CrO_3$, Mn: in terms of MnO; Fe: in terms of FeO; Co: in terms of CoO; Ni; in terms of NiO; Cu; in terms of CuO; Zn: in terms of ZnO; Zr: in terms of $ZrO_2$; Mo: in terms of $MoO_3$; and W: in terms of $WO_3$.

<Application of Treatment Solution>

The method of applying the above-described treatment solution to the surface of the grain oriented electrical steel sheet is not particularly limited but a conventionally known method may be used.

The treatment solution is preferably applied to both surfaces of the steel sheet and more preferably applied so that the coating amount on both the surfaces after baking becomes 4 to 15 g/m$^2$. The interlaminar insulation resistance may be reduced when the coating amount is too small, whereas the lamination factor may be more reduced when the coating amount is too large.

<Drying>

Since moisture dries in the temperature elevation process during baking, drying may not be separately performed before baking. However, the treatment solution is preferably sufficiently dried before baking and the grain oriented electrical steel sheet having the treatment solution applied thereto is more preferably dried (subjected to preliminary baking) before baking from the viewpoint of preventing poor film formation due to abrupt heating and also from the viewpoint that controlling the phosphate bonding state through reduction treatment of the insulating coating during baking, which is one characteristic feature of the invention, is stably performed.

To be more specific, for example, a steel sheet having the treatment solution applied thereto is preferably placed in a drying furnace and retained for drying at 150 to 450° C. for 10 seconds or more.

Under conditions of less than 150° C. and/or less than 10 seconds, drying may not be enough to obtain a desired binding state, and at a temperature higher than 450° C., the steel sheet may be oxidized during drying. In contrast, under conditions of 150 to 450° C. and 10 seconds or more, the steel sheet can be adequately dried while suppressing its oxidation.

A longer drying time is preferred but a drying time of 120 seconds or less is preferred because the productivity is easily reduced when the drying time exceeds 120 seconds.

<Baking>

Next, the grain oriented electrical steel sheet dried after application of the treatment solution is baked to form the insulating coating.

As described above, in order to obtain an insulating coating having excellent heat resistance, the P K-absorption edge XAFS spectrum of the insulating coating needs to show three absorption peaks between 2156 eV and 2180 eV. Although the method of forming such an insulating coating is not particularly limited, an exemplary method for obtaining the above-described feature need only include specific conditions for baking. To be more specific, the conditions should include 1) a higher baking temperature (hereinafter denoted by "T"), 2) a higher hydrogen concentration (hereinafter denoted by "$H_2$") in the baking atmosphere, and 3) a longer baking time (hereinafter denoted by "Time") at the baking temperature T.

The respective conditions are described below in further detail.

(Baking Temperature T)

The baking temperature T (unit: ° C.) is set in the range of $850 \leq T \leq 1000$. The baking temperature (T) is set to 850° C. or more so that the P K-absorption edge XAFS spectrum of the insulating coating shows three absorption peaks between 2156 eV and 2180 eV. On the other hand, when the baking temperature (T) is too high, crystallization of the primarily glassy insulating coating proceeds excessively to reduce the tension to be applied to the steel sheet. Therefore, the baking temperature is set to 1000° C. or less.

(Hydrogen Concentration $H_2$)

The hydrogen concentration $H_2$ (unit: vol %) in the baking atmosphere is set in the range of $0.3 \leq H_2 \leq 230-0.2T$. The hydrogen concentration ($H_2$) is set to 0.3 vol % or more so that the P K-absorption edge XAFS spectrum of the insulating coating shows three absorption peaks between 2156 eV and 2180 eV. On the other hand, when the hydrogen concentration ($H_2$) is too high, crystallization of the primarily glassy insulating coating proceeds excessively. The limit concentration is related to the baking temperature (T) and is set in the range of $H_2 \leq 230-0.2T$.

The remainder of the baking atmosphere except hydrogen is preferably an inert gas, and more preferably nitrogen.

(Baking Time Time)

The baking time Time (unit: s) is set in the range of $5 \leq Time \leq 860-0.8T$. The baking time (Time) is set to 5 seconds or more so that the P K-absorption edge XAFS spectrum of the insulating coating shows three absorption peaks between 2156 eV and 2180 eV. On the other hand, when the baking time (Time) is too long, again, crystallization of the insulating coating proceeds excessively. The limit time is related to the baking temperature (T) and is set in the range of $Time \leq 860-0.8T$.

Second Embodiment

Next, the manufacturing method of the invention is described with reference to the second embodiment.

In the foregoing first embodiment, a description was given of the specific baking conditions for forming, as an insulating coating having excellent heat resistance, the insulating coating of which the P K-absorption edge XAFS spectrum shows three absorption peaks between 2156 eV and 2180 eV. However, even when the baking conditions in the first embodiment are not met, for example, for lack of the hydrogen concentration $H_2$, the same insulating coating as in the first embodiment is obtained by further performing plasma treatment under specific conditions.

More specifically, the second embodiment of the manufacturing method of the invention is a method of manufacturing the grain oriented electrical steel sheet with an insulating coating according to the invention, the grain oriented electrical steel sheet with an insulating coating being obtained by performing baking and plasma treatment in this order after applying a treatment solution to a surface of a grain oriented electrical steel sheet having undergone finishing annealing, wherein the treatment solution contains a phosphate of at least one selected from the group consisting of Mg, Ca, Ba, Sr, Zn, Al and Mn, and colloidal silica, wherein a colloidal silica content in the treatment solution in terms of solid content is 50 to 150 parts by mass with respect to 100 parts by mass of total solids in the phosphate, wherein conditions of the baking in which a baking temperature T (unit: ° C.) ranges $800 \leq T \leq 1000$, a hydrogen concentration $H_2$ (unit: vol %) in a baking atmosphere ranges $0 \leq H_2 \leq 230-0.2T$, and a baking time Time (unit: s) at the baking temperature T ranges $Time \leq 300$ are met, and wherein the plasma treatment is a treatment which includes irradiating the surface of the grain oriented electrical steel sheet after the baking with plasma generated from plasma gas containing at least 0.3 vol % of hydrogen for 0.10 seconds or more.

Since conditions (treatment solution used, application method, and drying method) in the second embodiment are the same as those in the first embodiment except for baking and plasma treatment, their description is omitted.

<Baking>

In the second embodiment, it is found that plasma treatment is performed as the remedial treatment in a case where desired performance is not obtained, and acceptable ranges of the baking conditions are wider than those in the first embodiment. Even if the steel sheet obtained in the first embodiment of the manufacturing method of the invention is further subjected to plasma treatment, good performance is not impaired.

Specifically, as for the hydrogen concentration $H_2$ (unit: vol %) in the baking atmosphere, $0.3 \leq H_2 \leq 230-0.2T$ is met in the first embodiment but $0 \leq H_2 \leq 230-0.2T$ is set in the second embodiment. Good performance can be obtained even in the case of $0 \leq H_2 < 0.3$ in which desired properties were not obtained according to the first embodiment.

The baking temperature T (unit: ° C.) can also be set in a wider range than under the conditions in the first embodiment ($850 \leq T \leq 1000$), and is in the range of $800 \leq T \leq 1000$ in the second embodiment. In addition, the baking time Time (unit: s) at the baking temperature T is set in the range of $Time \leq 300$.

(Plasma Treatment)

As described above, even if the baking conditions do not meet the conditions in the first embodiment, an insulating coating which has excellent heat resistance and of which the P K-absorption edge XAFS spectrum shows three absorption peaks between 2156 eV and 2180 eV is obtained by further performing specific plasma treatment.

To be more specific, a surface of the grain oriented electrical steel sheet after the baking is irradiated with plasma generated from plasma gas containing at least 0.3 vol % of hydrogen for 0.10 seconds or more.

Plasma treatment is often performed in a vacuum, and vacuum plasma can be suitably used also in the present invention. However, the plasma treatment is not limited to this but, for example, atmospheric pressure plasma can also be used. Now simply referring to the atmospheric pressure plasma, the atmospheric pressure plasma is plasma generated under atmospheric pressure. The "atmospheric pressure" as used herein may be a pressure close to the atmospheric pressure, as exemplified by a pressure of $1.0 \times 10^4$ to $1.5 \times 10^5$ Pa.

For example, a radio frequency voltage is applied between opposed electrodes in the plasma gas (working gas) under atmospheric pressure to cause discharge to thereby generate plasma, and the surface of the steel sheet is irradiated with the plasma.

In this step, the plasma gas (working gas) is required to contain at least 0.3 vol % of hydrogen. When the hydrogen concentration is less than 0.3 vol %, excellent heat resistance is not obtained even after plasma treatment.

The upper limit of the hydrogen concentration in the plasma gas is not particularly limited, and is preferably 50 vol % or less and more preferably 10 vol % or less.

The gaseous remainder of the plasma gas except hydrogen preferably includes helium and argon because of easy plasma generation.

Plasma treatment is preferably performed after the temperature of the baked steel sheet dropped to 100° C. or less. In other words, it is preferable to irradiate the surface of the baked steel sheet whose temperature dropped to 100° C. or less with plasma. When the temperature is too high, the plasma generating portion may have a high temperature to cause a defect, but the defect can be suppressed at 100° C. or less.

The plasma irradiation time is set to 0.10 seconds or more because a beneficial effect is not obtained when the plasma irradiation time is too short. On the other hand, too long a plasma irradiation time does not cause a problem on the properties of the insulating coating, but the upper limit of the irradiation time is preferably 10 seconds or less from the viewpoint of productivity.

The plasma gas temperature (exit temperature) is preferably 200° C. or less, and more preferably 150° C. or less from the viewpoint that no thermal strain is applied to the steel sheet.

EXAMPLES

The present invention is described below more specifically by way of examples. However, the present invention is not limited thereto.

Experimental Example 1

[Manufacture of Grain Oriented Electrical Steel Sheet with Insulating Coating]

A grain oriented electrical steel sheet with a sheet thickness of 0.23 mm (magnetic flux density $B_8$: 1.912 T) that had undergone finishing annealing was prepared. The steel sheet was cut into a size of 100 mm×300 mm and pickled in 5 mass % phosphoric acid. Then, a treatment solution prepared by adding 50 parts by mass of colloidal silica (AT-30 manufactured by ADEKA Corporation; average particle size: 10 nm) and 25 parts by mass of $TiO_2$ with respect to 100 parts by mass of one or more phosphates listed in Table 1 below was applied so that the coating amount on both surfaces after baking became 10 g/m$^2$, and the steel sheet was then placed in a drying furnace and dried at 300° C. for 1 minute, and thereafter baked under conditions shown in Table 1 below. A grain oriented electrical steel sheet with an insulating coating in each example was thus manufactured.

Each phosphate used was in the form of a primary phosphate aqueous solution, and Table 1 below showed the amounts in terms of solid content. The remainder of the baking atmosphere except hydrogen was set to nitrogen.

[ΔW]

In each example, the amount of change (ΔW) of iron loss was determined by an expression shown below. The results are shown in Table 1 below.

$$\Delta W = W_{17/50}(C) - W_{17/50}(R)$$

$W_{17/50}(C)$: iron loss immediately after baking $W_{17/50}(R)$: iron loss immediately before applying the treatment solution (0.840 W/kg)

[Number of XAFS Peaks]

The insulating coating of the grain oriented electrical steel sheet with an insulating coating in each example was subjected to P K-absorption edge XAFS measurement by means of the total electron yield method (TEY) at the soft X-ray beam line BL-27A of KEK-PF, and the number of absorption peaks that could be seen between 2156 eV and 2180 eV in the resulting XAFS spectrum was counted. The results are shown in Table 1 below.

[Drop Height (Heat Resistance)]

The grain oriented electrical steel sheet with an insulating coating in each example was sheared into specimens measuring 50 mm×50 mm, 10 specimens were stacked on top of one another, and annealing under a compressive load of 2 kg/cm$^2$ was performed in a nitrogen atmosphere at 830° C. for 3 hours. Then, a weight of 500 g was dropped from heights of 20 to 120 cm at intervals of 20 cm to evaluate the heat resistance of the insulating coating based on the height of the weight (drop height) at which the 10 specimens were all separated from each other. In a case in which the 10 specimens were all separated from each other after the annealing under compressive loading but before the drop weight test, the drop height was set to 0 cm. When the specimens were separated from each other at a drop height of 40 cm or less, the insulating coating was rated as having excellent heat resistance. The results are shown in Table 1 below.

[Lamination Factor]

The lamination factor of the grain oriented electrical steel sheet with an insulating coating in each example was determined according to JIS C 2550-5:2011. As a result, in every example, the insulating coating did not contain oxide fine particles or the like, and the lamination factor was therefore as good as 97.8% or more.

[Corrosion Resistance]

The rate of rusting of the grain oriented electrical steel sheet with an insulating coating in each example was determined after exposing the steel sheet to an atmosphere of 40° C. and 100% humidity for 50 hours. As a result, in every example, the rate of rusting was 1% or less, and the corrosion resistance was good.

TABLE 1

| | Phosphate [parts by mass] (in terms of solid content) | | | | | | | Baking condition | | | | | | Number | | |
|---|---|---|---|---|---|---|---|---|---|---|---|---|---|---|---|---|
| No. | Magnesium phosphate | Calcium phosphate | Barium phosphate | Strontium phophate | Zinc phosphate | Aluminum phosphate | Manganese phosphate | T [° C.] | $H_2$ [vol %] | 230-0.2 T | Time [s] | 860-0.8 T | Δ W [W/kg] | of XAFS peaks | Drop height [cm] | Remarks |
| 1 | 100 | | | | | | | 800 | 0.3 | 70 | 30 | 220 | −0.020 | 1 | 120 | CE |
| 2 | 100 | | | | | | | 850 | 0.0 | 60 | 30 | 180 | −0.029 | 1 | 80 | CE |
| 3 | 100 | | | | | | | 850 | 0.3 | 60 | 3 | 180 | −0.029 | 1 | 60 | CE |
| 4 | 100 | | | | | | | 850 | 0.3 | 60 | 5 | 180 | −0.029 | 3 | 40 | IE |
| 5 | 100 | | | | | | | 850 | 0.0 | 60 | 180 | 180 | −0.017 | 1 | 100 | CE |
| 6 | 100 | | | | | | | 850 | 0.3 | 60 | 30 | 180 | −0.022 | 3 | 40 | IE |
| 7 | 100 | | | | | | | 900 | 0.3 | 50 | 5 | 140 | −0.030 | 3 | 40 | IE |
| 8 | 100 | | | | | | | 900 | 0.3 | 50 | 30 | 140 | −0.034 | 3 | 20 | IE |
| 9 | 100 | | | | | | | 900 | 5.0 | 50 | 30 | 140 | −0.028 | 3 | 20 | IE |
| 10 | 100 | | | | | | | 850 | 20.0 | 60 | 30 | 180 | −0.029 | 3 | 20 | IE |
| 11 | 100 | | | | | | | 850 | 60.0 | 60 | 30 | 180 | −0.034 | 3 | 20 | IE |
| 12 | 100 | | | | | | | 900 | 10.0 | 50 | 30 | 140 | −0.028 | 3 | 0 | IE |
| 13 | 100 | | | | | | | 900 | 50.0 | 50 | 30 | 140 | −0.029 | 3 | 0 | IE |
| 14 | | | | | | 100 | | 800 | 30.0 | 70 | 30 | 220 | −0.032 | 1 | 100 | CE |
| 15 | | | | | | 100 | | 900 | 0.0 | 50 | 30 | 140 | −0.031 | 1 | 80 | CE |
| 16 | | | | | | 100 | | 900 | 40.0 | 50 | 30 | 140 | −0.033 | 3 | 40 | IE |
| 17 | | | | | | 100 | | 900 | 40.0 | 50 | 5 | 140 | −0.030 | 3 | 40 | IE |
| 18 | | | | | | 100 | | 950 | 20.0 | 40 | 30 | 100 | −0.031 | 3 | 20 | IE |
| 19 | | | | | | 100 | | 950 | 40.0 | 40 | 30 | 100 | −0.032 | 3 | 20 | IE |
| 20 | | | | | | 100 | | 1000 | 0.0 | 30 | 30 | 60 | −0.026 | 1 | 60 | CE |
| 21 | | | | | | 100 | | 1000 | 30.0 | 30 | 2 | 60 | −0.026 | 1 | 60 | CE |
| 22 | | | | | | 100 | | 1000 | 30.0 | 30 | 5 | 60 | −0.028 | 3 | 40 | IE |
| 23 | | | | | | 100 | | 1000 | 30.0 | 30 | 30 | 60 | −0.027 | 3 | 20 | IE |
| 24 | 40 | | | | | 60 | | 850 | 5.0 | 60 | 180 | 180 | −0.018 | 3 | 20 | IE |
| 25 | | 50 | | | | 50 | | 850 | 40.0 | 60 | 20 | 180 | −0.029 | 3 | 20 | IE |
| 26 | | | 100 | | | | | 900 | 20.0 | 50 | 10 | 140 | −0.028 | 3 | 40 | IE |
| 27 | | | | 100 | | | | 900 | 10.0 | 50 | 140 | 140 | −0.019 | 3 | 20 | IE |
| 28 | | | | | 100 | | | 950 | 0.0 | 40 | 10 | 100 | −0.032 | 1 | 100 | CE |
| 29 | 70 | | | | | | 30 | 950 | 5.0 | 40 | 100 | 100 | −0.029 | 3 | 20 | IE |
| 30 | 80 | 20 | | | | | | 1000 | 0.3 | 30 | 60 | 60 | −0.018 | 3 | 40 | IE |
| 31 | 50 | | | | | 50 | | 1000 | 5.0 | 30 | 30 | 60 | −0.029 | 3 | 20 | IE |
| 32 | 50 | | | | 50 | | | 900 | 5.0 | 50 | 10 | 140 | −0.032 | 3 | 40 | IE |
| 33 | | | 50 | 50 | | | | 900 | 5.0 | 50 | 30 | 140 | −0.033 | 3 | 40 | IE |
| 34 | 60 | | | | | 40 | | 900 | 5.0 | 50 | 60 | 140 | −0.032 | 3 | 20 | IE |

CE: Comparative Example
IE: Inventive Example

As shown in Table 1 above, it was revealed that the insulating coatings in Inventive Examples in each of which the XAFS spectrum shows three absorption peaks between 2156 eV and 2180 eV have excellent heat resistance.

Experimental Example 2

[Manufacture of Grain Oriented Electrical Steel Sheet with Insulating Coating]

A grain oriented electrical steel sheet with a sheet thickness of 0.23 mm (magnetic flux density $B_8$: 1.912 T) that had undergone finishing annealing was prepared. The steel sheet was cut into a size of 100 mm×300 mm and pickled in 5 mass % phosphoric acid. Then, a treatment solution prepared by adding 70 parts by mass of colloidal silica (SNOWTEX 50 manufactured by Nissan Chemical Industries, Ltd.; average particle size: 30 nm) and further an M compound in an amount (in terms of oxide) shown in Table 2 below with respect to 100 parts by mass of one or more phosphates listed in Table 2 below was applied so that the coating amount on both surfaces after baking became 12 g/m$^2$, and the steel sheet was then placed in a drying furnace and dried at 300° C. for 1 minute, and thereafter baked under conditions shown in Table 2 below. A grain oriented electrical steel sheet with an insulating coating in each example was thus manufactured.

Each phosphate used was in the form of a primary phosphate aqueous solution, and Table 2 below showed the amounts in terms of solid content. The remainder of the baking atmosphere except hydrogen was set to nitrogen.

M compounds added to the treatment solution are listed below for each metal species of M.

Ti:$TiO_2$
V:$NH_4VO_3$
Cr:$CrO_2$
Mn:$Mn(NO_3)_2$
Fe:$FeSO_4.7H_2O$
Co:$Co(NO_3)_2$
Ni:$Ni(NO_3)_2$
Cu:$CuSO_4.5H_2O$
Zn:$ZnSO_4$
Zr:$ZrO_2$
Mo:$MoO_2$
W:$WO_3$

[ΔW]

In each example, the amount of change (LW) of iron loss was determined from the expression shown below. The results are shown in Table 2 below.

$$\Delta W = W_{17/50}(C) - W_{17/50}(R)$$

$W_{17/50}$(C): iron loss immediately after baking $W_{17/50}$(R): iron loss immediately before applying the treatment solution (0.840 W/kg)

[Number of XAFS Peaks]

The insulating coating of the grain oriented electrical steel sheet with an insulating coating in each example was subjected to P K-absorption edge XAFS measurement by means of the total electron yield method (TEY) at the soft X-ray beam line BL-27A of KEK-PF, and the number of absorption peaks that could be seen between 2156 eV and 2180 eV in the resulting XAFS spectrum was counted. The results are shown in Table 2 below.

[Drop Height (Heat Resistance)]

The grain oriented electrical steel sheet with an insulating coating in each example was sheared into specimens measuring 50 mm×50 mm, 10 specimens were stacked on top of one another, and annealing under a compressive load of 2 kg/cm$^2$ was performed in a nitrogen atmosphere at 830° C. for 3 hours. Then, a weight of 500 g was dropped from heights of 20 to 120 cm at intervals of 20 cm to evaluate the heat resistance of the insulating coating based on the height of the weight (drop height) at which the 10 specimens were all separated from each other. In a case in which the 10 specimens were all separated from each other after the annealing under compressive loading but before the drop weight test, the drop height was set to 0 cm. When the specimens were separated from each other at a drop height of 40 cm or less, the insulating coating was rated as having excellent heat resistance. The results are shown in Table 2 below.

[Lamination Factor]

The lamination factor of the grain oriented electrical steel sheet with an insulating coating in each example was determined according to JIS C 2550-5:2011. As a result, in every example, the insulating coating did not contain oxide fine particles or the like, and the lamination factor was therefore as good as 97.7% or more.

[Corrosion Resistance]

The rate of rusting of the grain oriented electrical steel sheet with an insulating coating in each example was determined after exposing the steel sheet to an atmosphere of 40° C. and 100% humidity for 50 hours. As a result, in every example, the rate of rusting was 1% or less, and the corrosion resistance was good.

TABLE 2

| | Phosphate [parts by mass] (in terms of solid content) | | | | M compound [parts by mass] (in terms of oxide) | | | | | | | | | | | | Baking condition | | | | | | | |
|---|---|---|---|---|---|---|---|---|---|---|---|---|---|---|---|---|---|---|---|---|---|---|---|---|
| No. | Magnesium phosphate | Calcium phophate | Barium phosphate | Aluminum phosphate | Ti | V | Cr | Mn | Fe | Co | Ni | Cu | Zn | Zr | Mo | W | T [° C.] | $H_2$ [vol %] | 230-0.2 T | Time [s] | 860-0.8 T | Δ W [W/kg] | Number of XAFS peaks | Drop height [cm] | Remarks |
| 1 | 100 | | | | | | | | | | | | | | | | 800 | 0.3 | 70 | 30 | 220 | −0.015 | 1 | 120 | CE |
| 2 | 100 | | | | | | | | | | | | | | | | 850 | 2.0 | 60 | 30 | 180 | −0.019 | 3 | 20 | IE |
| 3 | 100 | | | | | | | | | | | | | | | | 850 | 0.3 | 60 | 3 | 180 | −0.020 | 1 | 60 | CE |
| 4 | 100 | | | | | | 5 | | | | | | | | | | 850 | 0.3 | 60 | 5 | 180 | −0.020 | 3 | 40 | IE |
| 5 | 100 | | | | | | 10 | | | | | | | | | | 850 | 0.0 | 60 | 180 | 180 | −0.032 | 1 | 100 | CE |
| 6 | 100 | | | | | | 50 | | | | | | | | | | 850 | 0.3 | 60 | 30 | 180 | −0.038 | 3 | 40 | IE |
| 7 | 100 | | | | | | | | | | | | | | | | 900 | 0.2 | 50 | 5 | 140 | −0.020 | 1 | 100 | CE |
| 8 | 100 | | | | | | | | | | | | | | | | 900 | 0.3 | 50 | 30 | 140 | −0.021 | 3 | 20 | IE |
| 9 | 100 | | | | | 10 | | | | | | | | | | | 900 | 5.0 | 50 | 30 | 140 | −0.038 | 3 | 20 | IE |
| 10 | 100 | | | | | 80 | | | | | | | | | | | 850 | 20.0 | 60 | 30 | 180 | −0.040 | 3 | 20 | IE |
| 11 | 100 | | | | | | | 10 | | | | | | | | | 850 | 60.0 | 60 | 30 | 180 | −0.030 | 3 | 20 | IE |
| 12 | 100 | | | | | | | 50 | | | | | | | | | 900 | 10.0 | 50 | 30 | 140 | −0.033 | 3 | 0 | IE |
| 13 | 100 | | | | | | | | | | | | | | | | 900 | 50.0 | 50 | 30 | 140 | −0.020 | 3 | 0 | IE |
| 14 | | | | 100 | | | | | | | | | | | | | 800 | 30.0 | 70 | 30 | 220 | −0.014 | 1 | 100 | CE |
| 15 | | | | 100 | | | | | 5 | | | | | | | | 900 | 0.0 | 50 | 30 | 140 | −0.015 | 1 | 80 | CE |
| 16 | | | | 100 | | | | | 10 | | | | | | | | 900 | 40.0 | 50 | 30 | 140 | −0.033 | 3 | 40 | IE |
| 17 | | | | 100 | | | | | 120 | | | | | | | | 900 | 40.0 | 50 | 5 | 140 | −0.018 | 3 | 40 | IE |
| 18 | | | | 100 | | | | | | | 10 | | | | | | 950 | 20.0 | 40 | 30 | 100 | −0.031 | 3 | 20 | IE |
| 19 | | | | 100 | | | | | | | | 10 | | | | | 950 | 40.0 | 40 | 30 | 100 | −0.032 | 3 | 20 | IE |
| 20 | | | | 100 | | | | | | | | | 10 | | | | 1000 | 0.0 | 30 | 30 | 60 | −0.030 | 1 | 60 | CE |
| 21 | | | | 100 | | | | | | | | | | 10 | | | 1000 | 30.0 | 30 | 2 | 60 | −0.032 | 1 | 60 | CE |
| 22 | | | | 100 | | | | | | | | | | | 10 | | 1000 | 30.0 | 30 | 5 | 60 | −0.033 | 3 | 40 | IE |
| 23 | | | | 100 | | | | | | 5 | | | | | 5 | 5 | 1000 | 30.0 | 30 | 30 | 60 | −0.031 | 3 | 20 | IE |
| 24 | 40 | | | 60 | | | | | | | | 5 | | 5 | | | 850 | 5.0 | 60 | 180 | 180 | −0.032 | 3 | 20 | IE |
| 25 | | 50 | | 50 | 5 | 5 | | | | | | | | | | | 850 | 40.0 | 60 | 20 | 180 | −0.031 | 3 | 20 | IE |
| 26 | | | 100 | | | | | 5 | 5 | | | | | | | | 900 | 20.0 | 50 | 10 | 140 | −0.035 | 3 | 40 | IE |
| 27 | 50 | 50 | | | | 5 | | | 5 | | | | | 5 | | | 900 | 10.0 | 50 | 140 | 140 | −0.033 | 3 | 20 | IE |
| 28 | | | 50 | 50 | | | | | | | | | | | | | 950 | 0.0 | 40 | 10 | 100 | −0.019 | 1 | 100 | CE |
| 29 | 70 | | | | | 5 | | | | | | | | | | | 950 | 5.0 | 40 | 100 | 100 | −0.020 | 3 | 20 | IE |
| 30 | 80 | 20 | | | | 10 | | | | | | | | | | | 1000 | 0.3 | 30 | 60 | 60 | −0.030 | 3 | 40 | IE |
| 31 | 50 | | | 50 | 100 | | | | | | | | | | | | 1000 | 5.0 | 30 | 30 | 60 | −0.038 | 3 | 20 | IE |
| 32 | 50 | | | 50 | 120 | | | | | | | | | | | | 900 | 5.0 | 50 | 10 | 140 | −0.019 | 3 | 40 | IE |
| 33 | | 50 | 50 | | | | | | 100 | | | | | | | | 900 | 5.0 | 50 | 30 | 140 | −0.033 | 3 | 40 | IE |
| 34 | 60 | | | 40 | | | | | 150 | | | | | | | | 900 | 5.0 | 50 | 60 | 140 | −0.015 | 3 | 20 | IE |

CE: Comparative Example
IE: Inventive Example

As shown in Table 2 above, it was revealed that the insulating coatings in Inventive Examples in each of which the XAFS spectrum shows three absorption peaks between 2156 eV and 2180 eV have excellent heat resistance.

Experimental Example 3

A grain oriented electrical steel sheet with a sheet thickness of 0.23 mm (magnetic flux density $B_8$: 1.912 T) that had undergone finishing annealing was prepared. The steel sheet was cut into a size of 100 mm×300 mm and pickled in 5 mass % phosphoric acid. Then, a treatment solution prepared by adding 75 parts by mass of colloidal silica (AT-50 manufactured by ADEKA Corporation; average particle size: 23 nm) and 50 parts by mass (in terms of FeO) of iron oxide sol with respect to 100 parts by mass of one or more phosphates listed in Table 3 below was applied so that the coating amount on both surfaces after baking became 9 g/m$^2$, and the steel sheet was then placed in a drying furnace and dried at 300° C. for 1 minute, and thereafter subjected to baking and plasma treatment under conditions shown in Table 3 below. A grain oriented electrical steel sheet with an insulating coating in each example was thus manufactured.

Each phosphate used was in the form of a primary phosphate aqueous solution, and Table 3 below showed the amounts in terms of solid content. The remainder of the baking atmosphere except hydrogen was set to nitrogen.

At the beginning of plasma treatment, the steel sheet temperature after baking was room temperature.

In plasma treatment, the steel sheet was irradiated with atmospheric pressure plasma. The atmospheric pressure plasma device used was PF-DFL manufactured by Plasma Factory Co., Ltd., and the plasma head used was a linear plasma head having a width of 300 mm.

The gas species of the plasma gas (working gas) included Ar, Ar—$N_2$, or Ar—$H_2$, and the total flow rate was set to 30 L/min.

The plasma width was set to 3 mm. The plasma head was fixed and the steel sheet conveying speed was varied to vary the irradiation time to thereby uniformly perform plasma treatment on the entire surface of the steel sheet. The irradiation time was calculated by dividing the plasma width (3 mm) by the conveyance speed (unit: mm/s).

[ΔW]

In each example, the amount of change (LW) of iron loss was determined by an expression shown below. The results are shown in Table 3 below.

$$\Delta W = W_{17/50}(P) - W_{17/50}(R)$$

$W_{17/50}$(P): iron loss immediately after plasma treatment $W_{17/50}$(R): iron loss immediately before applying the treatment solution (0.840 W/kg)

[Number of XAFS Peaks]

The insulating coating of the grain oriented electrical steel sheet with an insulating coating in each example was subjected to P K-absorption edge XAFS measurement by means of the total electron yield method (TEY) at the beam line BL-10 or BL-13 of Ritsumeikan University Sr Center, and the number of absorption peaks that could be seen between 2156 eV and 2180 eV in the resulting XAFS spectrum was counted.

In each example, measurement was made before and after plasma irradiation. The results are shown in Table 3 below.

[Drop Height (Heat Resistance)]

The grain oriented electrical steel sheet with an insulating coating in each example was sheared into specimens measuring 50 mm×50 mm, 10 specimens were stacked on top of one another, and annealing under a compressive load of 2 kg/cm$^2$ was performed in a nitrogen atmosphere at 830° C. for 3 hours. Then, a weight of 500 g was dropped from heights of 20 to 120 cm at intervals of 20 cm to evaluate the heat resistance of the insulating coating based on the height of the weight (drop height) at which the 10 specimens were all separated from each other. In a case in which the 10 specimens were all separated from each other after the annealing under compressive loading but before the drop weight test, the drop height was set to 0 cm. When the specimens were separated from each other at a drop height of 40 cm or less, the insulating coating was rated as having excellent heat resistance. The results are shown in Table 3 below.

[Lamination Factor]

The lamination factor of the grain oriented electrical steel sheet with an insulating coating in each example was determined according to JIS C 2550-5:2011. As a result, in every example, the insulating coating did not contain oxide fine particles or the like, and the lamination factor was therefore as good as 97.9% or more.

[Corrosion Resistance]

The rate of rusting of the grain oriented electrical steel sheet with an insulating coating in each example was determined after exposing the steel sheet to an atmosphere of 40° C. and 100% humidity for 50 hours. As a result, in every example, the rate of rusting was 1% or less, and the corrosion resistance was good.

TABLE 3

| | Phosphate [parts by mass] (in terms of solid content) | | | | | | | Baking condition | | | |
|---|---|---|---|---|---|---|---|---|---|---|---|
| No. | Magnesium phosphate | Calcium phosphate | Barium phosphate | Strontium phosphate | Zinc phosphate | Aluminum phosphate | Manganese phosphate | T [° C.] | $H_2$ (vol %) | 230-0.2 T | Time [s] |
| 1 | 100 | | | | | | | 800 | 0.0 | 70 | 30 |
| 2 | 100 | | | | | | | 800 | 0.0 | 70 | 30 |
| 3 | 100 | | | | | | | 800 | 0.0 | 70 | 30 |
| 4 | 100 | | | | | | | 900 | 0.2 | 50 | 120 |
| 5 | 100 | | | | | | | 800 | 0.0 | 70 | 30 |
| 6 | 100 | | | | | | | 800 | 0.0 | 70 | 30 |
| 7 | 100 | | | | | | | 800 | 0.0 | 70 | 30 |
| 8 | 100 | | | | | | | 800 | 0.2 | 70 | 3 |
| 9 | 100 | | | | | | | 800 | 0.0 | 70 | 30 |
| 10 | 100 | | | | | | | 850 | 0.1 | 60 | 20 |
| 11 | 100 | | | | | | | 800 | 0.0 | 70 | 30 |
| 12 | 100 | | | | | | | 800 | 0.0 | 70 | 30 |
| 13 | 100 | | | | | | | 1000 | 0.1 | 30 | 60 |
| 14 | | | | | | 100 | | 850 | 0.0 | 60 | 60 |
| 15 | | | | | | 100 | | 850 | 0.1 | 60 | 60 |

TABLE 3-continued

| | | | | | | | | | | | |
|---|---|---|---|---|---|---|---|---|---|---|---|
| 16 | | | | | | 100 | | 850 | 0.2 | 60 | 60 |
| 17 | | | | | | 100 | | 900 | 0.2 | 50 | 60 |
| 18 | | | | | | 100 | | 950 | 0.2 | 40 | 60 |
| 19 | | | | | | 100 | | 950 | 0.0 | 40 | 30 |
| 20 | | | | | | 100 | | 1000 | 0.0 | 30 | 30 |
| 21 | | | | | | 100 | | 1000 | 0.0 | 30 | 5 |
| 22 | | | | | | 100 | | 1000 | 0.1 | 30 | 3 |
| 23 | | | | | | 100 | | 1000 | 0.0 | 30 | 3 |
| 24 | 40 | | | | | 60 | | 800 | 0.0 | 70 | 30 |
| 25 | | 50 | | | | 50 | | 800 | 0.0 | 70 | 30 |
| 26 | | | 100 | | | | | 800 | 0.2 | 70 | 3 |
| 27 | | | | 100 | | | | 800 | 0.0 | 70 | 30 |
| 28 | | | | | 100 | | | 800 | 0.0 | 70 | 30 |
| 29 | 70 | | | | | | 30 | 1000 | 0.0 | 30 | 5 |
| 30 | 80 | 20 | | | | | | 850 | 0.1 | 60 | 2 |
| 31 | 50 | | | | | 50 | | 850 | 0.2 | 60 | 60 |
| 32 | 50 | | | | 50 | | | 950 | 0.1 | 40 | 30 |
| 33 | | | 50 | 50 | | | | 1000 | 0.1 | 30 | 30 |
| 34 | 60 | | | | | 40 | | 1000 | 0.0 | 30 | 120 |

| | Plasma treatment condition | | | | | | Number of XAES peaks | | Drop | |
|---|---|---|---|---|---|---|---|---|---|---|
| No. | Ar [L/min] | $N_2$ [L/min] | $H_2$ [L/min] | $H_2$ [vol %] | Irradiation time [s] | Δ W [W/kg] | Before irradiation | After irradiation | height [cm] | Remarks |
| 1 | 30.0 | 0 | 0 | 0.0 | 3.00 | −0.028 | 1 | I | 120 | CE |
| 2 | 29.9 | 0.1 | 0 | 0.0 | 3.00 | −0.026 | 1 | 1 | 100 | CE |
| 3 | 29.5 | 0.5 | 0 | 0.0 | 3.00 | −0.027 | 1 | 1 | 120 | CE |
| 4 | 28.5 | 1.5 | 0 | 0.0 | 3.00 | −0.026 | 1 | 1 | 120 | CE |
| 5 | 28.0 | 2.0 | 0 | 0.0 | 5.00 | −0.028 | 1 | 1 | 100 | CE |
| 6 | 29.9 | 0 | 0.1 | 0.3 | 0.05 | −0.026 | 1 | 1 | 80 | CE |
| 7 | 29.9 | 0 | 0.1 | 0.3 | 0.10 | −0.024 | 1 | 3 | 40 | IE |
| 8 | 29.9 | 0 | 0.1 | 0.3 | 1.00 | −0.026 | 1 | 3 | 40 | IE |
| 9 | 29.9 | 0 | 0.1 | 0.3 | 3.00 | −0.028 | 1 | 3 | 20 | IE |
| 10 | 29.7 | 0 | 0.3 | 1.0 | 3.00 | −0.032 | 1 | 3 | 20 | IE |
| 11 | 29.5 | 0 | 0.5 | 1.7 | 3.00 | −0.025 | 1 | 3 | 20 | IE |
| 12 | 28.5 | 0 | 1.5 | 5.0 | 5.00 | −0.023 | 1 | 3 | 0 | IE |
| 13 | 29.9 | 0 | 0.1 | 0.3 | 3.00 | −0.038 | 1 | 3 | 40 | IE |
| 14 | 29.9 | 0 | 0.1 | 0.3 | 3.00 | −0.035 | 1 | 3 | 40 | IE |
| 15 | 29.9 | 0 | 0.1 | 0.3 | 3.00 | −0.032 | 1 | 3 | 40 | IE |
| 16 | 29.9 | 0 | 0.1 | 0.3 | 3.00 | −0.033 | 1 | 3 | 40 | IE |
| 17 | 29.9 | 0 | 0.1 | 0.3 | 3.00 | −0.036 | 1 | 3 | 40 | IE |
| 18 | 29.9 | 0 | 0.1 | 0.3 | 3.00 | −0.036 | 1 | 3 | 20 | IE |
| 19 | 29.9 | 0 | 0.1 | 0.3 | 3.00 | −0.036 | 1 | 3 | 40 | IE |
| 20 | 29.9 | 0 | 0.1 | 0.3 | 3.00 | −0.038 | 1 | 3 | 40 | IE |
| 21 | 29.9 | 0 | 0.1 | 0.3 | 3.00 | −0.037 | 1 | 3 | 40 | IE |
| 22 | 29.9 | 0 | 0.1 | 0.3 | 3.00 | −0.036 | 1 | 3 | 40 | IE |
| 23 | 29.9 | 0 | 0.1 | 0.3 | 3.00 | −0.033 | 1 | 3 | 40 | IE |
| 24 | 29.9 | 0.1 | 0 | 0.0 | 3.00 | −0.023 | 1 | 1 | 120 | CE |
| 25 | 28.0 | 2.0 | 0 | 0.0 | 5.00 | −0.026 | 1 | 1 | 120 | CE |
| 26 | 29.9 | 0 | 0.1 | 0.3 | 1.00 | −0.024 | 1 | 3 | 40 | IE |
| 27 | 29.5 | 0 | 0.5 | 1.7 | 3.00 | −0.023 | 1 | 3 | 20 | IE |
| 28 | 28.5 | 0 | 1.5 | 5.0 | 5.00 | −0.024 | 1 | 3 | 20 | IE |
| 29 | 29.9 | 0 | 0.1 | 0.3 | 3.00 | −0.035 | 1 | 3 | 20 | IE |
| 30 | 29.9 | 0 | 0.1 | 0.3 | 0.05 | −0.028 | 1 | 1 | 100 | CE |
| 31 | 29.9 | 0 | 0.1 | 0.3 | 0.05 | −0.031 | 1 | 1 | 120 | CE |
| 32 | 29.9 | 0 | 0.1 | 0.3 | 0.05 | −0.031 | 1 | 1 | 120 | CE |
| 33 | 29.9 | 0 | 0.1 | 0.3 | 0.05 | −0.033 | 1 | 1 | 120 | CE |
| 34 | 29.9 | 0 | 0.1 | 0.3 | 3.00 | −0.038 | 1 | 3 | 20 | IE |

CE: Comparative Example
IE: Inventive Example

As shown in Table 3 above, it was revealed that the insulating coatings in Inventive Examples in which only one peak is seen between 2156 eV and 2180 eV before plasma treatment but three peaks appear owing to the subsequent plasma treatment have excellent heat resistance.

Experimental Example 4

A grain oriented electrical steel sheet with a sheet thickness of 0.23 mm (magnetic flux density $B_8$: 1.912 T) that had undergone finishing annealing was prepared. The steel sheet was cut into a size of 100 mm×300 mm and pickled in 5 mass % phosphoric acid. Then, a treatment solution prepared by adding 55 parts by mass of colloidal silica (SNOWTEX 30 manufactured by Nissan Chemical Industries, Ltd.; average particle size: 15 nm) and further an M compound in an amount (in terms of oxide) shown in Table 4 below with respect to 100 parts by mass of one or more phosphates listed in Table 4 below was applied so that the coating amount on both surfaces after baking became 14 g/m$^2$, and the steel sheet was then placed in a drying furnace and dried at 300° C. for 1 minute, and thereafter subjected to baking and plasma treatment under conditions shown in Table 4 below. A grain oriented electrical steel sheet with an insulating coating in each example was thus manufactured.

Each phosphate used was in the form of a primary phosphate aqueous solution, and Table 4 below showed the amounts in terms of solid content. The remainder of the baking atmosphere except hydrogen was set to nitrogen.

M compounds added to the treatment solution are listed below for each metal species of M.

Ti:$TiO_2$
V:$V_2O_5$
Cr:$CrO_3$
Mn:$MnCO_3$
Fe:$Fe_2O_3$
Co:$CoSO_4$
Ni:$NiSO_4$
Cu:$Cu(NO_3)_2$
Zn:$ZnCO_3$
Zr:$Zr(SO_4)_2.4H_{2O}$
Mo:$MoS_2$
W:$K_2WO_4$

At the beginning of plasma treatment, the steel sheet temperature after baking was room temperature.

In plasma treatment, the steel sheet was irradiated with atmospheric pressure plasma. The atmospheric pressure plasma device used was PF-DFL manufactured by Plasma Factory Co., Ltd., and the plasma head used was a linear plasma head having a width of 300 mm.

The gas species of the plasma gas (working gas) included Ar, Ar—$N_2$, or Ar—$H_2$, and the total flow rate was set to 30 L/min.

The plasma width was set to 3 mm. The plasma head was fixed and the steel sheet conveying speed was varied to vary the irradiation time to thereby uniformly perform plasma treatment on the entire surface of the steel sheet. The irradiation time was calculated by dividing the plasma width (3 mm) by the conveyance speed (unit: mm/s).

[ΔW]

In each example, the amount of change (ΔW) of iron loss was determined from the expression shown below. The results are shown in Table 4 below.

$$\Delta W = W_{17/50}(P) - W_{17/50}(R)$$

$W_{17/50}(P)$: iron loss immediately after plasma treatment
$W_{17/50}(R)$: iron loss immediately before applying the treatment solution (0.840 W/kg)

[Number of XAFS Peaks]

The insulating coating of the grain oriented electrical steel sheet with an insulating coating in each example was subjected to P K-absorption edge XAFS measurement by means of the total electron yield method (TEY) at the beam line BL-10 or BL-13 of Ritsumeikan University Sr Center, and the number of absorption peaks that could be seen between 2156 eV and 2180 eV in the resulting XAFS spectrum was counted.

In each example, measurement was made before and after plasma irradiation. The results are shown in Table 4 below.

[Drop Height (Heat Resistance)]

The grain oriented electrical steel sheet with an insulating coating in each example was sheared into specimens measuring 50 mm×50 mm, 10 specimens were stacked on top of one another, and annealing under a compressive load of 2 kg/cm$^2$ was performed in a nitrogen atmosphere at 830° C. for 3 hours. Then, a weight of 500 g was dropped from heights of 20 to 120 cm at intervals of 20 cm to evaluate the heat resistance of the insulating coating based on the height of the weight (drop height) at which the 10 specimens were all separated from each other. In a case in which the 10 specimens were all separated from each other after the annealing under compressive loading but before the drop weight test, the drop height was set to 0 cm. When the specimens were separated from each other at a drop height of 40 cm or less, the insulating coating was rated as having excellent heat resistance. The results are shown in Table 4 below.

[Lamination Factor]

The lamination factor of the grain oriented electrical steel sheet with an insulating coating in each example was determined according to JIS C 2550-5:2011. As a result, in every example, the insulating coating did not contain oxide fine particles or the like, and the lamination factor was therefore as good as 97.7% or more.

[Corrosion Resistance]

The rate of rusting of the grain oriented electrical steel sheet with an insulating coating in each example was determined after exposing the steel sheet to an atmosphere of 40° C. and 100% humidity for 50 hours. As a result, in every example, the rate of rusting was 1% or less, and the corrosion resistance was good.

TABLE 4

| | Phosphate [parts by mass] (in terms of solid content) | | | | M compound [parts by mass] (in terms of oxide) | | | | | | | | | | | |
|---|---|---|---|---|---|---|---|---|---|---|---|---|---|---|---|---|
| No. | Magnesium phosphate | Calcium phosphate | Barium phosphate | Aluminum phosphate | Ti | V | Cr | Mn | Fe | Co | Ni | Cu | Zn | Zr | Mo | W |
| 1 | 100 | | | | | | | | | | | | | | | |
| 2 | 100 | | | | | | | | | | | | | | | |
| 3 | 100 | | | | | | | | | | | | | | | |
| 4 | 100 | | | | | | 5 | | | | | | | | | |
| 5 | 100 | | | | | | 10 | | | | | | | | | |
| 6 | 100 | | | | | | 50 | | | | | | | | | |
| 7 | 100 | | | | | | | | | | | | | | | |
| 8 | 100 | | | | | | | | | | | | | | | |
| 9 | 100 | | | | | 10 | | | | | | | | | | |
| 10 | 100 | | | | | 80 | | | | | | | | | | |
| 11 | 100 | | | | | | | 10 | | | | | | | | |
| 12 | 100 | | | | | | | 50 | | | | | | | | |
| 13 | 100 | | | | | | | | | | | | | | | |
| 14 | | | | 100 | | | | | | | | | | | | |
| 15 | | | | 100 | | | | | 5 | | | | | | | |
| 16 | | | | 100 | | | | | 10 | | | | | | | |
| 17 | | | | 100 | | | | | 120 | | | | | | | |
| 18 | | | | 100 | | | | | | | 10 | | | | | |

TABLE 4-continued

| | | | | | | | | | | | | | | | |
|---|---|---|---|---|---|---|---|---|---|---|---|---|---|---|---|
| 19 | | | | 100 | | | | | | | | 10 | | | |
| 20 | | | | 100 | | | | | | | | | 10 | | |
| 21 | | | | 100 | | | | | | | | | | 10 | |
| 22 | | | | 100 | | | | | | | | | | | 10 |
| 23 | | | | 100 | | | | | | 5 | | | | | 5 5 |
| 24 | 40 | | | 60 | | | | | | | | 5 | | 5 | |
| 25 | | 50 | | 50 | 5 | 5 | | | | | | | | | |
| 26 | | | 100 | | | | 5 | 5 | | | | | | | |
| 27 | 50 | 50 | | | | 5 | | 5 | | | | | | 5 | |
| 28 | | | 50 | 50 | | | | | | | | | | | |
| 29 | 70 | | | | | 5 | | | | | | | | | |
| 30 | 80 | 20 | | | | 10 | | | | | | | | | |
| 31 | 50 | | | 50 | 100 | | | | | | | | | | |
| 32 | 50 | | | 50 | 120 | | | | | | | | | | |
| 33 | | 50 | 50 | | | | | 100 | | | | | | | |
| 34 | 60 | | | 40 | | | | 150 | | | | | | | |

| | Baking condition | | | | Plasma treatment condition | | | | | | Number of XAFS peaks | | | |
|---|---|---|---|---|---|---|---|---|---|---|---|---|---|---|
| No. | T [° C.] | $H_2$ [vol %] | 230-0.2 T | Time [s] | Ar [L/min] | $N_2$ [L/min] | $H_2$ [L/min] | $H_2$ [vol %] | Irradiation time [s] | Δ W [W/kg] | Before irradiation | After irradiation | Drop height [cm] | Remarks |
| 1 | 800 | 0.0 | 70 | 30 | 30.0 | 0 | 0 | 0.0 | 3.00 | −0.015 | 1 | 1 | 120 | CE |
| 2 | 800 | 0.0 | 70 | 30 | 29.9 | 0 | 0.1 | 0.3 | 3.00 | −0.019 | 1 | 1 | 40 | IE |
| 3 | 800 | 0.0 | 70 | 30 | 29.5 | 0.5 | 0 | 0.0 | 3.00 | −0.020 | 1 | 1 | 120 | CE |
| 4 | 900 | 0.2 | 50 | 120 | 28.5 | 0 | 1.5 | 5.0 | 3.00 | −0.020 | 1 | 3 | 20 | IE |
| 5 | 800 | 0.0 | 70 | 30 | 28.0 | 2.0 | 0 | 0.0 | 5.00 | −0.033 | 1 | 1 | 100 | CE |
| 6 | 800 | 0.0 | 70 | 30 | 29.9 | 0 | 0.1 | 0.3 | 0.10 | −0.038 | 1 | 3 | 40 | IE |
| 7 | 800 | 0.0 | 70 | 30 | 29.9 | 0.1 | 0 | 0.0 | 0.10 | −0.020 | 1 | 1 | 100 | CE |
| 8 | 800 | 0.2 | 70 | 3 | 29.9 | 0 | 0.1 | 0.3 | 1.00 | −0.021 | 1 | 3 | 40 | IE |
| 9 | 800 | 0.0 | 70 | 30 | 29.9 | 0 | 0.1 | 0.3 | 3.00 | −0.037 | 1 | 3 | 20 | IE |
| 10 | 850 | 0.1 | 60 | 20 | 29.7 | 0 | 0.3 | 1.0 | 3.00 | −0.039 | 1 | 3 | 20 | IE |
| 11 | 800 | 0.0 | 70 | 30 | 29.5 | 0 | 0.5 | 1.7 | 3.00 | −0.030 | 1 | 3 | 20 | IE |
| 12 | 800 | 0.0 | 70 | 30 | 28.0 | 0 | 1.5 | 5.0 | 5.00 | −0.032 | 1 | 3 | 0 | IE |
| 13 | 1000 | 0.1 | 30 | 60 | 20.9 | 0 | 0.1 | 0.3 | 3.00 | −0.020 | 1 | 3 | 40 | IE |
| 14 | 850 | 0.0 | 60 | 60 | 29.9 | 0.1 | 0 | 0.0 | 3.00 | −0.014 | 1 | 1 | 100 | CE |
| 15 | 850 | 0.1 | 60 | 60 | 29.9 | 0 | 0.1 | 0.3 | 0.05 | −0.015 | 1 | 1 | 100 | CE |
| 16 | 850 | 0.2 | 60 | 60 | 29.9 | 0 | 0.1 | 0.3 | 3.00 | −0.032 | 1 | 3 | 40 | IE |
| 17 | 900 | 0.2 | 50 | 60 | 29.9 | 0 | 0.7 | 0.3 | 3.00 | −0.018 | 1 | 3 | 40 | IE |
| 18 | 950 | 0.2 | 40 | 60 | 29.9 | 0 | 0.2 | 0.3 | 3.00 | −0.031 | 1 | 3 | 20 | IE |
| 19 | 950 | 0.0 | 40 | 30 | 29.9 | 0 | 0.1 | 0.3 | 3.00 | −0.030 | 1 | 3 | 40 | IE |
| 20 | 1000 | 0.0 | 30 | 30 | 29.9 | 0 | 0.1 | 0.3 | 3.00 | −0.030 | 1 | 3 | 40 | IE |
| 21 | 1000 | 0.0 | 30 | 5 | 29.9 | 0 | 0.1 | 0.3 | 3.00 | −0.032 | 1 | 3 | 40 | IE |
| 22 | 1000 | 0.1 | 30 | 3 | 29.9 | 0 | 0.1 | 0.3 | 3.00 | −0.033 | 1 | 3 | 40 | IE |
| 23 | 1000 | 0.0 | 30 | 3 | 29.9 | 0 | 0.1 | 0.3 | 3.00 | −0.030 | 1 | 3 | 40 | IE |
| 24 | 800 | 0.0 | 70 | 30 | 29.9 | 0 | 0.1 | 0.3 | 3.00 | −0.032 | 1 | 3 | 20 | IE |
| 25 | 800 | 0.0 | 70 | 30 | 28.0 | 0 | 2.0 | 6.7 | 5.00 | −0.031 | 1 | 3 | 0 | IE |
| 26 | 800 | 0.2 | 70 | 3 | 29.9 | 0 | 0.1 | 0.3 | 2.00 | −0.034 | 1 | 3 | 40 | IE |
| 27 | 800 | 0.0 | 70 | 30 | 29.5 | 0 | 0.5 | 1.7 | 3.00 | −0.033 | 1 | 3 | 20 | IE |
| 28 | 800 | 0.0 | 70 | 30 | 28.5 | 0 | 1.5 | 5.0 | 0.05 | −0.019 | 1 | 1 | 80 | CE |
| 29 | 1000 | 0.0 | 30 | 5 | 29.9 | 0 | 0.1 | 0.3 | 3.00 | −0.020 | 1 | 3 | 20 | IE |
| 30 | 850 | 0.1 | 60 | 2 | 29.9 | 0 | 0.1 | 0.3 | 2.00 | −0.030 | 1 | 3 | 20 | IE |
| 31 | 850 | 0.2 | 60 | 60 | 29.9 | 0 | 0.1 | 0.3 | 2.00 | −0.037 | 1 | 3 | 20 | IE |
| 32 | 950 | 0.1 | 40 | 30 | 29.9 | 0 | 0.1 | 0.3 | 2.00 | −0.019 | 1 | 3 | 20 | IE |
| 33 | 1000 | 0.1 | 30 | 30 | 29.9 | 0 | 0.1 | 0.3 | 2.00 | −0.033 | 1 | 3 | 20 | IE |
| 34 | 1000 | 0.0 | 30 | 120 | 29.9 | 0 | 0.1 | 0.3 | 3.00 | −0.015 | 1 | 3 | 20 | IE |

CE: Comparative Example
IE: Inventive Example

As shown in Table 4 above, it was revealed that the insulating coatings in Inventive Examples in which only one peak is seen between 2156 eV and 2180 eV before plasma treatment but three peaks appear owing to the subsequent plasma treatment have excellent heat resistance.

The invention claimed is:

1. A method of manufacturing a grain oriented electrical steel sheet with an insulating coating, comprising:

a grain oriented electrical steel sheet; and an insulating coating provided on a surface of the grain oriented electrical steel sheet, wherein the insulating coating contains at least one selected from the group consisting of Mg, Ca, Ba, Sr, Zn, Al and Mn, and Si, P, and O, and wherein a P K-absorption edge XAFS spectrum of the insulating coating shows three absorption peaks between 2156 eV and 2180 eV, the grain oriented electrical steel sheet with an insulating coating being obtained by performing baking and plasma treatment in this order after applying a treatment solution to a surface of a grain oriented electrical steel sheet having undergone finishing annealing, wherein the treatment solution contains a phosphate of at least one selected from the group consisting of Mg, Ca, Ba, Sr, Zn, Al and Mn, and colloidal silica, wherein a colloidal silica content in the treatment solution in terms of solid content is 50 to 150 parts by mass with respect to 100 parts by mass of total solids in the phosphate, wherein conditions of the baking in which a baking temperature T (unit: ° C.) ranges $800 \leq T \leq 1000$, a hydrogen concentration $H_2$ (unit: vol %) in a baking atmosphere ranges $0 \leq H_2 \leq 0.2$, and a baking time Time (unit: s) at the baking temperature T ranges Time≤300 are met, and wherein the plasma treatment is a treatment which includes irradiating an entire surface of the grain oriented electrical steel sheet after the baking with plasma generated from plasma gas containing at least 0.3 vol % to at most 6.7 vol % of hydrogen for 0.10 seconds or more.

2. The method of manufacturing the grain oriented electrical steel sheet with an insulating coating according to claim 1, wherein the grain oriented electrical steel sheet having undergone finishing annealing and having the treatment solution applied thereto is retained at a temperature of 150 to 450° C. for 10 seconds or more before being subjected to the baking and the plasma treatment.

3. The method of manufacturing the grain oriented electrical steel sheet with an insulating coating according to claim 2, wherein when at least one selected from the group consisting of Ti, V, Cr, Mn, Fe, Co, Ni, Cu, Zn, Zr, Mo, and W is denoted by M, the treatment solution further contains an M compound, and the M compound is contained in the treatment solution in an amount in terms of oxide of 5 to 150 parts by mass with respect to 100 parts by mass of total solids in the phosphate.

4. The method of manufacturing the grain oriented electrical steel sheet with an insulating coating according to claim 1, wherein when at least one selected from the group consisting of Ti, V, Cr, Mn, Fe, Co, Ni, Cu, Zn, Zr, Mo, and W is denoted by M, the treatment solution further contains an M compound, and the M compound is contained in the treatment solution in an amount in terms of oxide of 5 to 150 parts by mass with respect to 100 parts by mass of total solids in the phosphate.

* * * * *